US007204383B2

(12) United States Patent
Hsu

(10) Patent No.: US 7,204,383 B2
(45) Date of Patent: Apr. 17, 2007

(54) SEAL CONTAINER

(75) Inventor: Chun-Feng Hsu, Yongkang (TW)

(73) Assignee: Jumper Enterprise Co., Ltd., Tainan (TW)

( * ) Notice: Subject to any disclaimer, the term of this patent is extended or adjusted under 35 U.S.C. 154(b) by 526 days.

(21) Appl. No.: 10/868,068

(22) Filed: Jun. 16, 2004

(65) Prior Publication Data

US 2005/0279746 A1 Dec. 22, 2005

(51) Int. Cl.
*B65D 39/12* (2006.01)
*B65D 53/00* (2006.01)

(52) U.S. Cl. ..... 220/238; 220/233; 220/803; 215/359

(58) Field of Classification Search ..... 220/234, 220/237, 238, 301, 801; 215/358, 359, 360; 138/89
See application file for complete search history.

(56) References Cited

U.S. PATENT DOCUMENTS 208,647 A * 10/1878 Steinmetz ..... 215/359
287,189 A * 10/1883 Stone ..... 220/238
304,312 A * 9/1884 Guptill ..... 215/359
323,636 A * 8/1885 Comly ..... 215/359
701,117 A * 5/1902 Winterlich ..... 215/359
2,479,862 A * 8/1949 Payne ..... 215/359
4,295,578 A * 10/1981 Parent ..... 220/234
4,303,171 A * 12/1981 Schremmer ..... 220/238
4,316,550 A * 2/1982 de Winter ..... 215/360
4,387,825 A * 6/1983 Parent ..... 220/234
4,401,228 A * 8/1983 Baldelli ..... 220/235
4,942,970 A * 7/1990 Jay ..... 215/358

* cited by examiner

*Primary Examiner*—Anthony D. Stashick
*Assistant Examiner*—James Smalley
(74) *Attorney, Agent, or Firm*—Rosenberg, Klein & Lee

(57) ABSTRACT

A seal container includes a container, a lid, a knob fitted on the lid, a soft seal fitted over a lower side of the lid, and a depressing member arranged under the knob and connected with a middle of the seal at a lower end; the depressing member has several slopes on an annular edge; the knob has projections, which are spaced on an annular edge, and touch the slopes respectively; the depressing member will move down, and the seal will be depressed at the middle to reduce in circumference immediately after the knob is turned to such a position that the projections touch higher ends of the slopes; the seal will stretch to a normal shape to seal the container immediately after the knob is turned to such a position that the projections touch lower ends of the slopes.

3 Claims, 7 Drawing Sheets

SEAL CONTAINER

BACKGROUND OF THE INVENTION

1. Field of the Invention

The present invention relates to a seal container, more particularly one, which includes a seal member for a container body, and a knob usable for changing the seal member to a sealing shape as well as an unsealing shape, and which is structured in such a way as to be convenient to use and have extended service life.

2. Brief Description of the Prior Art

Referring to FIGS. 1 and 2, a conventional seal container includes a lid 10, a soft seal member 20, and a container body 30. The lid 10 has cavities 101, and a through hole under the cavities 101. Two pressing elements 102 are held in the cavities, and pivoted to the lid 10. The soft seal member 20 is fitted over a lower end of the lid 10 to face the through hole of the lid 10 at a middle portion. The pressing elements 102 will be away from the soft seal member 20, and the seal member 20 will be in a normal shape, in which shape it can stretch and closely touch an inner side of the container body 30 to seal the container body 30, if the pressing elements 102 are not pushed towards each other at upper ends thereof. And, the soft seal member 20 will be made to reduce in circumference, and can't touch the inner side of the container body 30 closely any more when the pressing elements 102 are pushed towards each other at the upper ends so as to depress the middle portion of the soft seal member 20.

The above seal container has the following disadvantages:

1. It is difficult to make a mold for the lid 10 because the lid 10 has the cavities 101.
2. Dust will accumulate in the space between both of the pressing elements 102 as well as the space between the pressing elements 102 and the lid 10, and the lid 10 is difficult to clean because of the structure. And, dust will drop onto the soft seal member 20 while the pressing elements 102 are being moved. Consequently, smoothness of movement of the pressing elements 102, and sealing capability of the soft seal member 20 will gradually reduce.
3. The user has to exert relatively large force on the pressing elements 102 otherwise the soft seal member 20 can't be effectively reduced in the circumference to change to the unsealing position. In other words, the seal container isn't convenient to use.

Referring to FIGS. 3 and 4, another conventional seal container includes a lid 40, a knob member 50, a soft seal member 60, and a container body 70. The lid 40 has a central hole 401, a touching portion 402 around the central hole 401 on a lower side, and a stopping portion 404 on the lower side, which touching portion 402 is formed with several slopes 403 of equal length on a lower end thereof. The knob member 50 has a middle portion, several spaced touching blocks 501 next to the middle portion, and a stopping projection 502 on an edge. The knob member 50 is up and down movably passed through the central hole 401 of the lid 40 at the middle portion with the touching blocks 501 touching respective ones of the slopes 403 of the lid 40. Thus, the knob 50 will be in a higher position after it is turned such that the touching blocks 501 thereof touch higher ends of the slopes 403, and it will be in a lower position after it is turned such that the touching blocks 501 thereof touch lower ends of the slopes 403; the stopping projection 502 will come into contact with one end of the stopping portion 404 of the lid 40 as soon as the touching blocks 501 touch the lower ends of the slopes 403 of the lid 40, and it 502 will come into contact with the other end of the stopping portion 404 as soon as the touching blocks 501 touch the upper ends of the slopes 403.

The soft seal member 60 is fitted over the lower side of the lid 40, and has bumps 601 spaced apart on an edge of a lower side thereof, every two adjacent ones of which define a space 602 in between. The container body 70 has several bumps 701 spaced apart on an inner side thereof. When the lid 40 is used to cover the container body 70, the bumps 701 of the container body 70 will be held in the spaces 602 of the soft seal member 60.

And, the seal member 60 will be in a normal shape, in which shape it can stretch and closely touch the inner side of the container body 70 to seal the container body 70, when the knob member 50 is in the higher position. And, the soft seal member 60 will be depressed at the middle portion by the knob member 50, and reduced in circumference, and can't closely touch the inner side of the container body 70 any more when the knob member 50 is in the lower position. Thus, the container body 70 will be sealed with the seal member 60 as soon as the knob member 50 is turned so as to move to the higher position after the container body 70 has been covered with the lid 40. And, the lid 40 can be easily fitted in, and removed from the container body 70. after the knob member 50 is turned so as to move to the lower position.

In the second seal container, knob member 50 is used instead of pivotal pressing elements 102 as the means used for reducing the soft seal member therefore the second seal container is more convenient to use than the first one. However, the second seal container still has disadvantages as followings:

1. Dust is likely to accumulate in the central hole 401 of the lid 40 and between the touching blocks 501 and the slopes 403 because the knob member 50 will move up and down relative to the lid 40 when it is used. Consequently, smoothness and range of movement of the knob member 50 will gradually reduce, and the seal member 60 can't have enough sealing capability.
2. Because of the engagement of the spaced bumps 601 of the seal member 60 with the spaced bumps 701 of the container body 70, when the knob member 50 is used, the lid 40 is prevented from turning relative to the container body 70; thus, the knob member 50 can be easily displaced relative to the lid 40. However, the bumps 601 will wear owing to external force thereon that is caused when the knob member 50 is turned, therefore they get damaged after the seal container is used for a certain period of time. Consequently, the bumps 601 and 701 can't prevent the lid 40 from turning relative to the container body 70.
3. Because of the range of movement of the knob member 50 is limited by means of two ends of the stopping portion 404 of the lid 40, the user has to turn the knob member 50 in a reverse direction to move the same back to the higher position after the knob member 50 is used to depress the soft seal member 60. Consequently, the seal container isn't convenient to use.

SUMMARY

It is a main object of the present invention to provide an improvement on a seal container to overcome the above disadvantages.

The seal container of the present invention includes a container, a lid, a knob fitted on the lid, a soft seal fitted over a lower side of the lid, and a depressing member arranged under the knob and connected with a middle of the seal at a lower end. The depressing member has several slopes on an annular edge thereof. The knob has projections, which are spaced on an annular edge thereof, and touch the slopes respectively. The depressing member will move down, and the seal will be depressed at the middle thereof to reduce in circumference as soon as the knob is turned to such a position that the projections thereof touch higher ends of the slopes of the depressing member. And, the seal will stretch to a normal shape to seal the container as soon as the knob is turned to such a position that the projections as soon as touch lower ends of the slopes.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
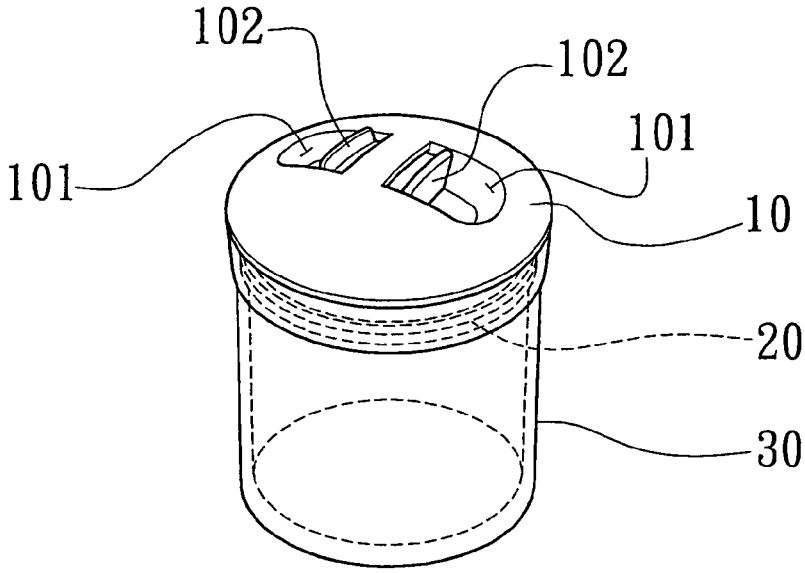
F I G. 1 (PRIOR ART)
FIG. 1 is a perspective view of the first conventional seal container.
Figure 2:
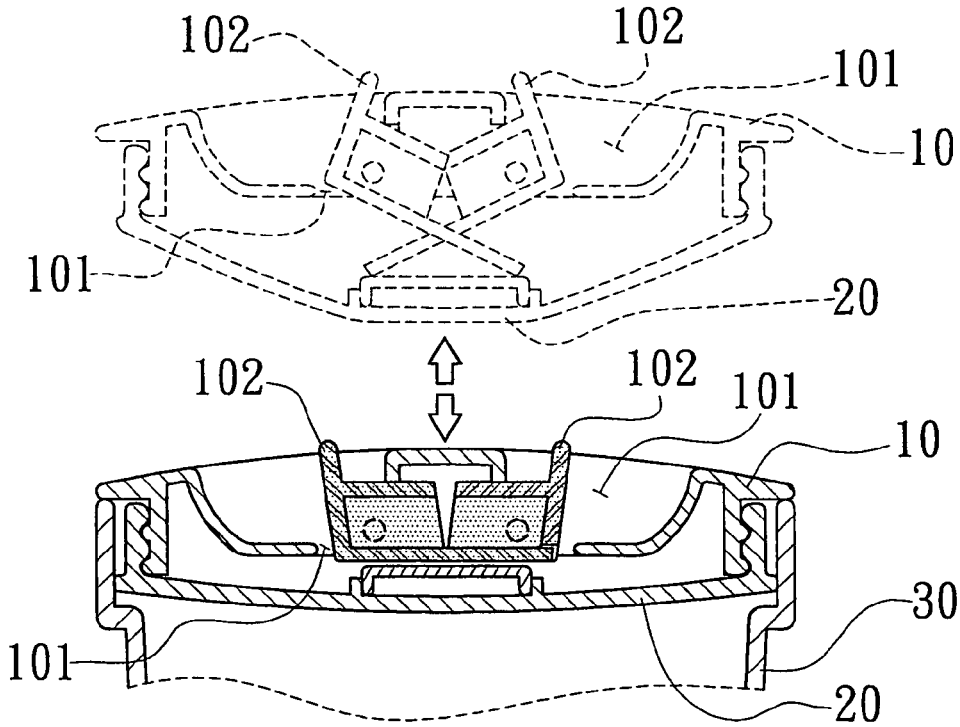
F I G. 2 (PRIOR ART)
FIG. 2 is a vertical section of the first conventional container, the seal member moving from the sealing position to the unsealing position.
Figure 3:
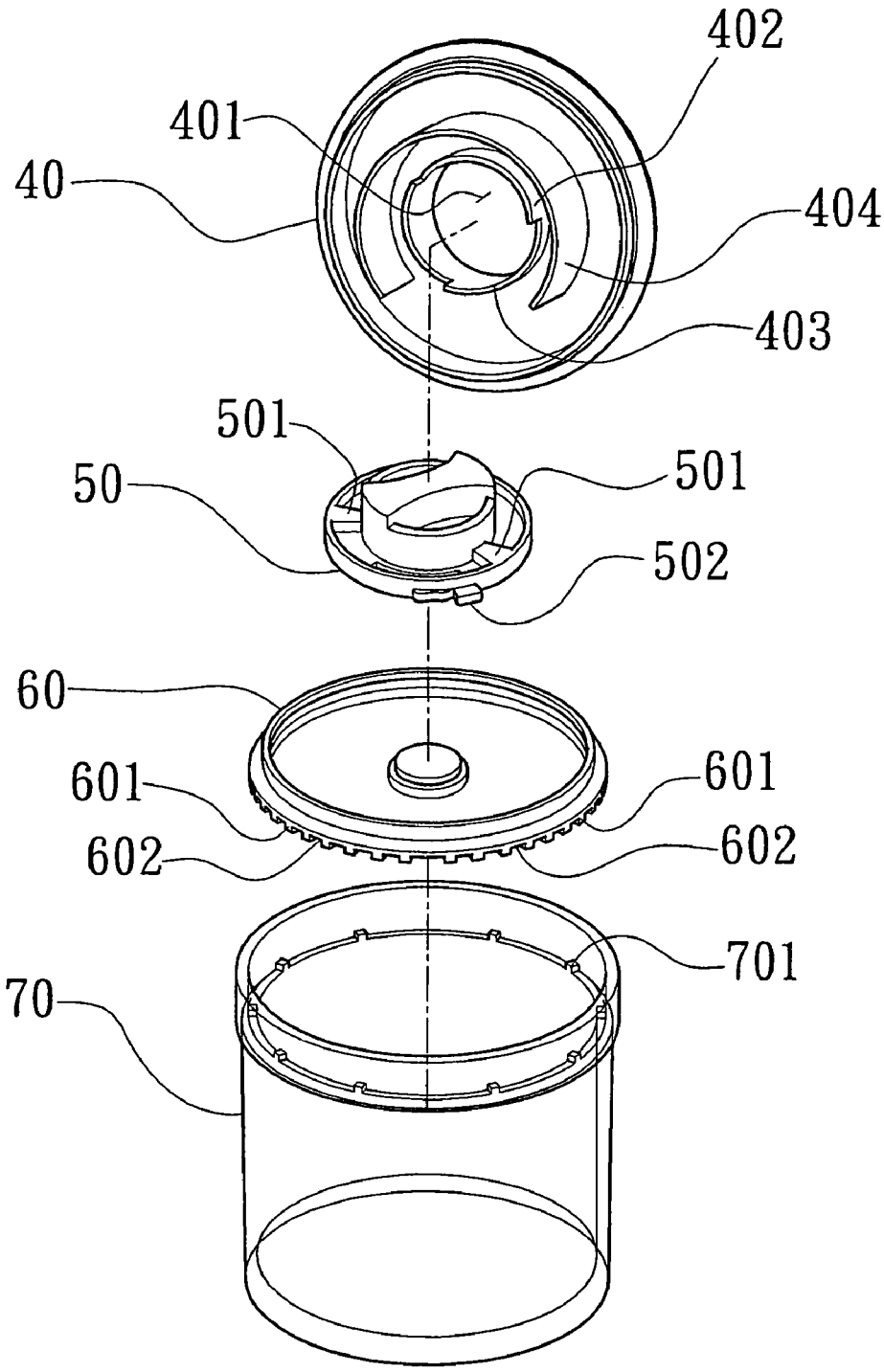
F I G. 3 (PRIOR ART)
FIG. 3 is an exploded perspective view of the second conventional seal container.
Figure 4:
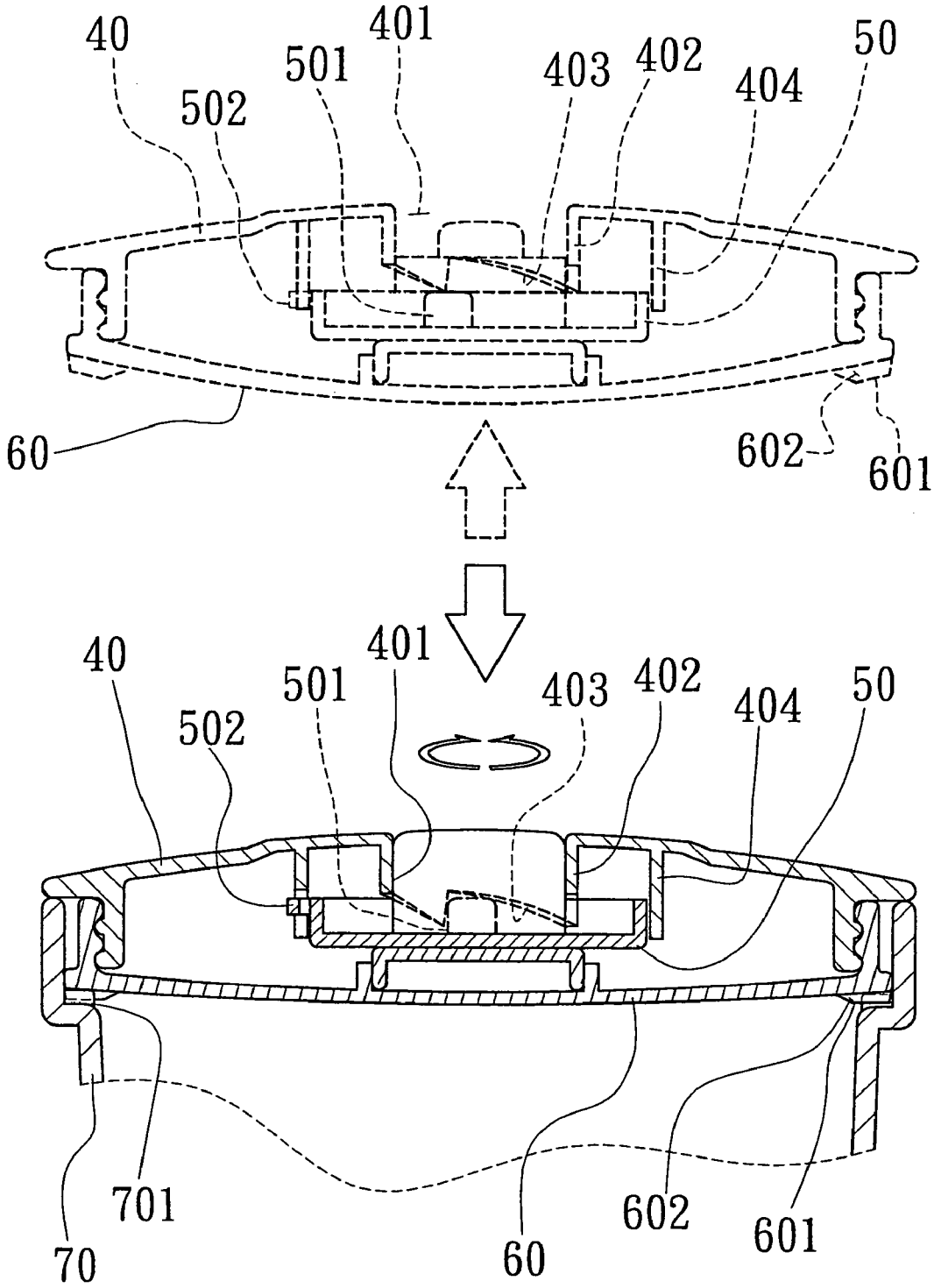
F I G. 4 (PRIOR ART)
FIG. 4 is a vertical section of the second conventional container, the seal member moving from the sealing position to the unsealing one.
Figure 5:
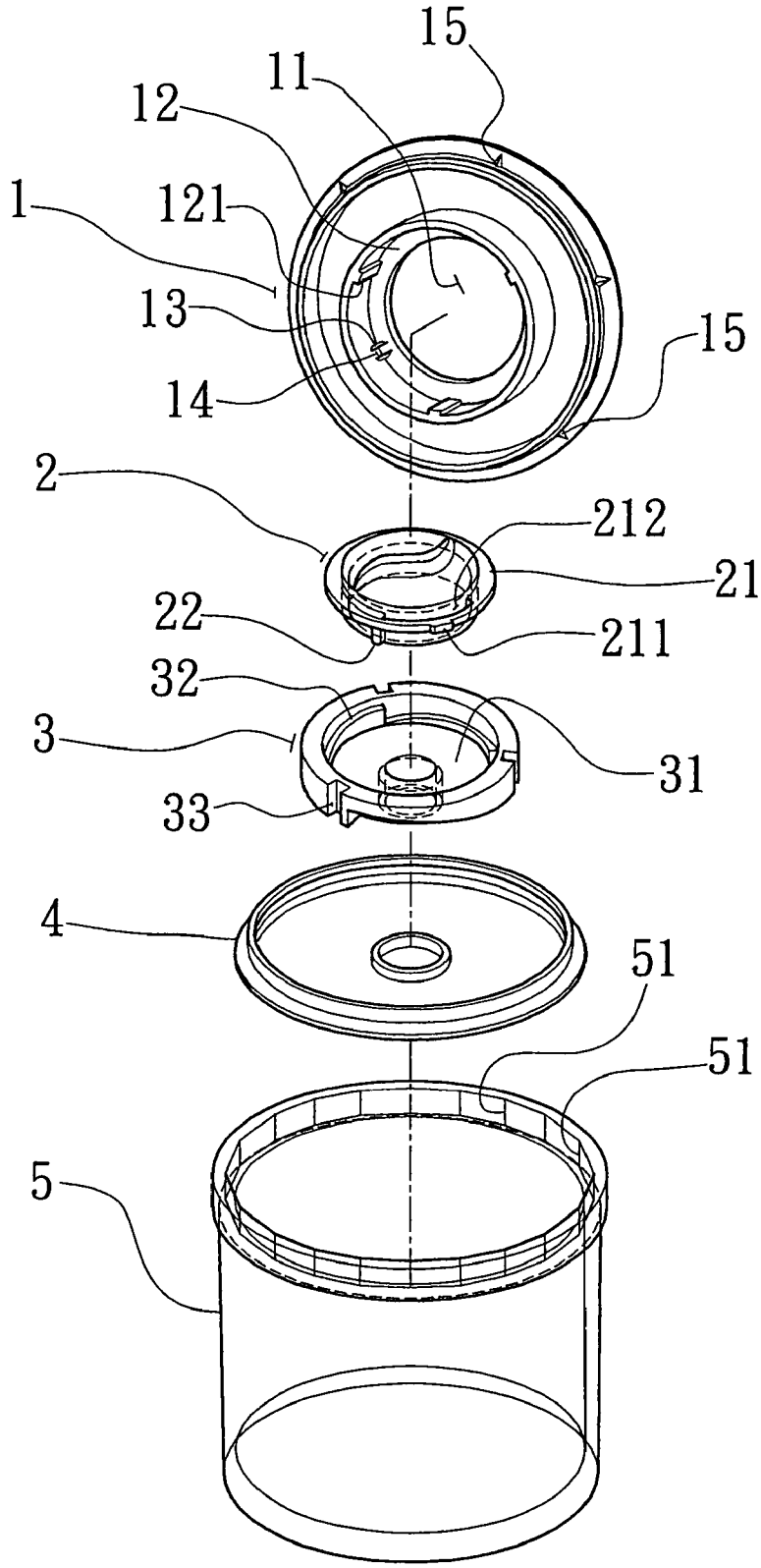
FIG. 5 is an exploded perspective view of the seal container according to the present invention.
Figure 7:
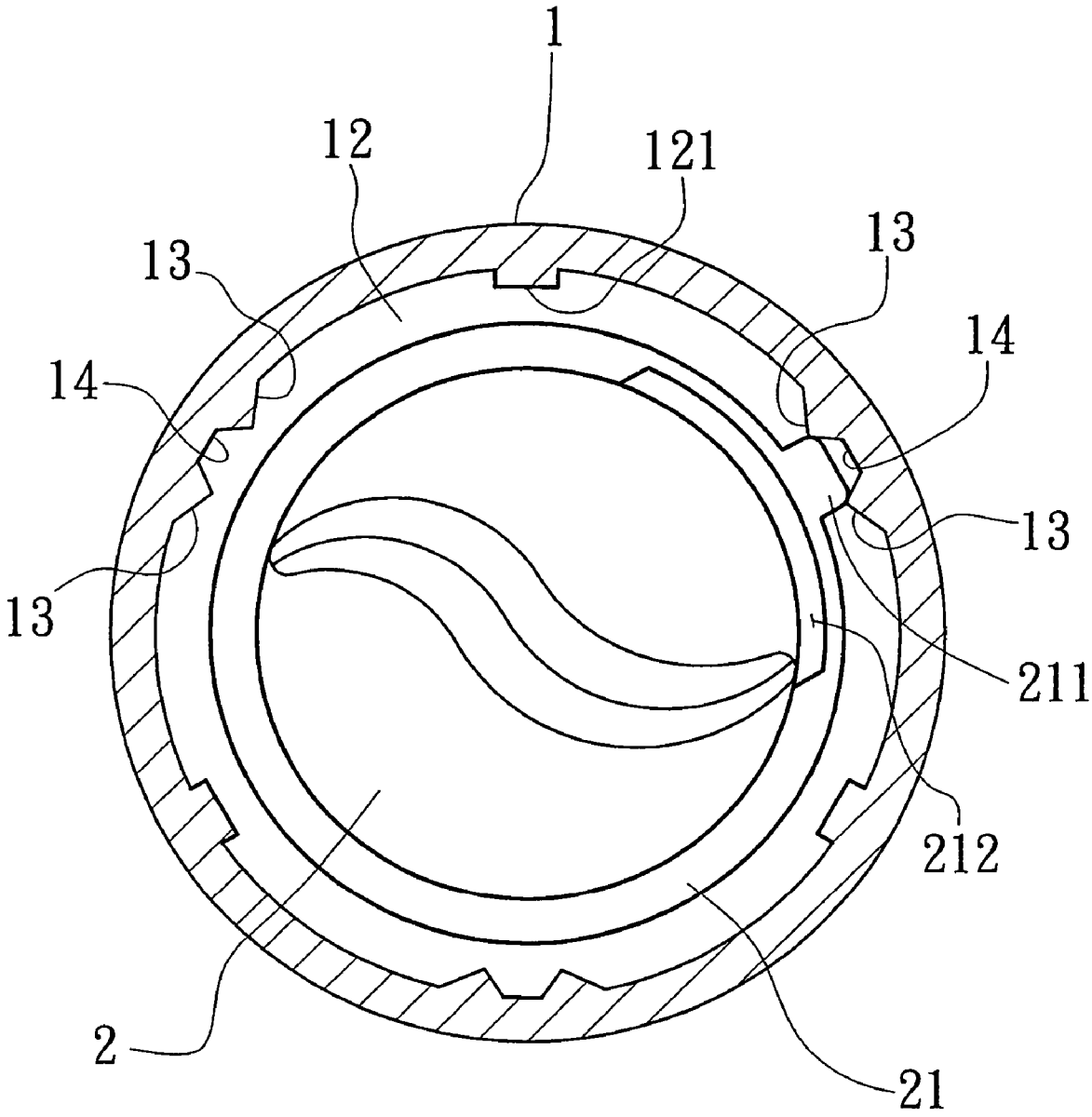
FIG. 7 is a horizontal section of the present seal container.

Referring to FIGS. 5 and 7, a preferred embodiment of a seal container includes a lid 1, a knob member 2, a depressing member 3, a soft seal member 4, and a container body 5.

The lid 1 has a central hole 11, an annular portion on a lower side, a holding room 12 defined by the annular portion, several guide bumps 121 spaced apart on an inner side of the annular portion, a pair of locating bumps 13 between every two adjacent ones of the guide bumps 121, and locating projections 15 on an edge of a lower side thereof; each of the locating bumps 13 includes two sloping sides, which together form an angle; each pair of locating bumps 13 define a holding space 14 in between.

The knob member 2 has a central raised portion, a rim 21 around the central raised portion, several touching projections 22 spaced apart on an annular side under the rim 21, and an engaging projection 211 on an edge of the rim 21. An elongated hole 212 is formed near to the engaging projection 211 on the rim 21 such that the engaging projection 211 can be easily displaced when an external pushing force towards the elongated hole 212 is exerted on the engaging projection 211. The knob member 2 is passed through the central hole 11 of the lid 1 at the central raised portion with the rim 21 being confined in the holding room 12, and stopped by those portions of the lid 1 that define the central hole 11; thus, one can exert force on the central raised portion of the knob member 2 to change the orientation of the knob member 2 relative to the lid 1.

The depressing member 3 has an annular portion, which defines a holding room 31, several up facing slopes 32 of the same shape around the holding room 31 on an inner side of the annular portion, and several spaced apart cavities 33 on an outer side of the annular portion thereof; the slopes 32 are formed such that lower ends thereof are adjacent to a higher end of a next slope 32. The depressing member 3 is held in the holding room 12 of the lower side of the lid 1 with the annular portion thereof being around the touching projections 22, with the slopes 32 coming into contact with respective ones of lower ends of the touching projections 22 of the knob member 2, and with the guide bumps 121 of the lid 1 being respectively held in the cavities 33 thereof. Therefore, the depressing member 3 can be up and down displaced relative to the lid 1 but it can't be angularly displaced relative to the lid 1.

The container body 5 is formed with spaced apart angle portions 51 on an inner side of an upper end thereof, and has an inner touching side under the angle portions 51 for touching the soft seal member 4; when the container body 5 is covered with the lid 1, the locating projections 15 of the lid 1 will be held in the angle portions 51 of the container body 5 such that the lid 1 can't turn relative to the container body 5.

Figure 6:
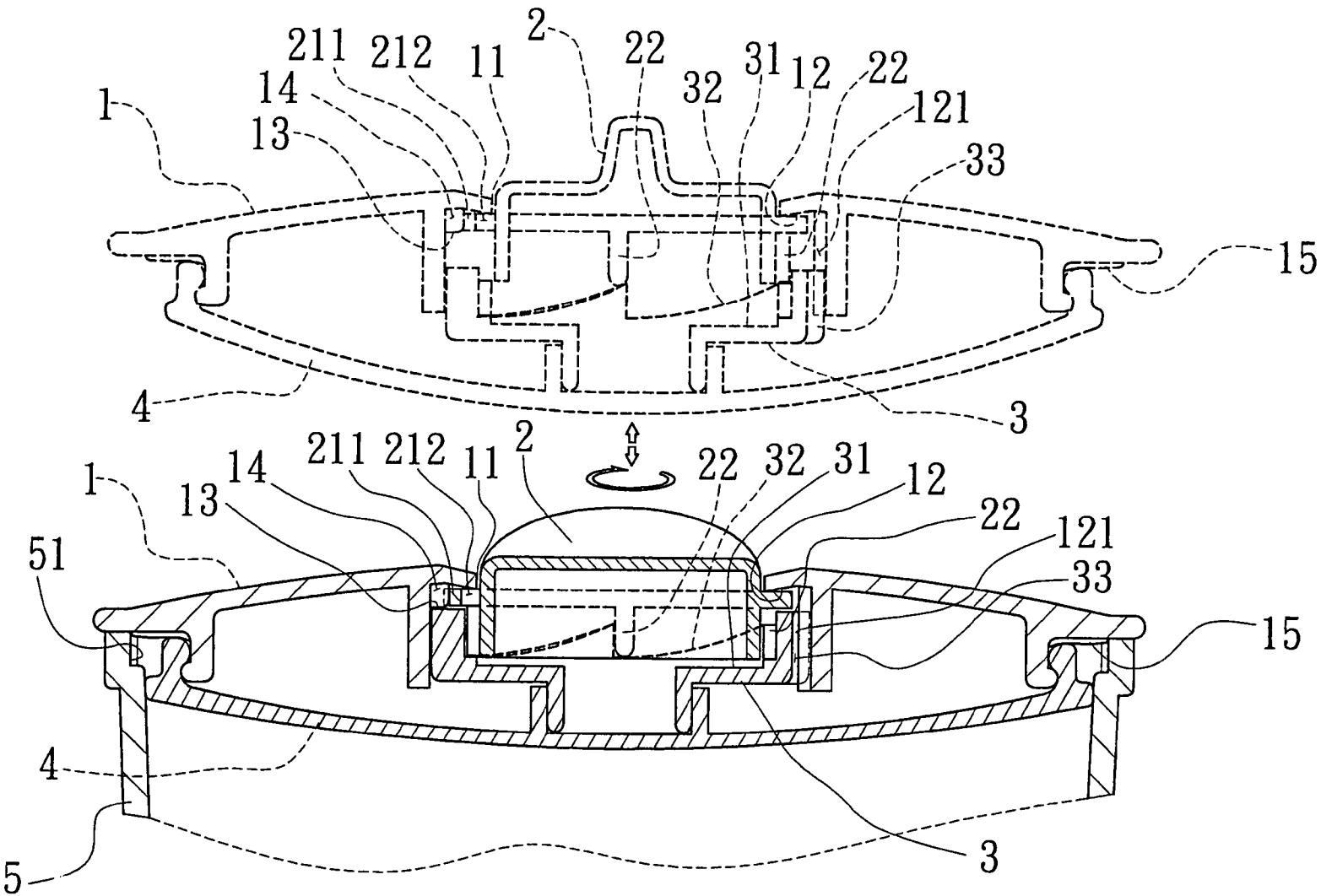
FIG. 6 is a partial vertical section of the present seal container, the seal member moving from the sealing position to the unsealing position.

Referring to FIG. 6, the soft seal member 4 is fitted over the lower end of the lid 1, and connected with the lower side of the depressing member 3 so as to bias the depressing member 3 upwards. Thus, the depressing member 3 will be in a higher position after the knob member 2 is turned to such a position as to touch the lower ends of the slopes 32 at the touching projections 22, and it will be in a lower position after the knob member 2 is turned to such a position as to touch the higher ends of the slopes 32 at the touching projections 22.

In addition, the seal member 4 will be allowed to stretch to a normal shape and closely touch the inner touching side of the container body 5 to seal the container body 5, when the depressing member 3 is in the higher position, as shown in lower part of FIG. 6. And, the soft seal member 4 will be depressed at the middle portion thereof by the depressing member 3 to reduce in the circumference, and can't closely touch the inner touching side of the container body 5 any more when the depressing member 3 is in the lower position, as shown in upper part of FIG. 6. The engaging projection 211 of the knob member 2 will pass into one of the holding spaces 14 of the lid 1 as soon as the depressing member 3 is moved to the lower position to reduce the seal member 4 so as to unseal the container body 5, as shown in FIG. 7; thus, the knob member 2 is prevented from turning relative to the lid 1, and the seal member 4 is kept in the unsealing position.

Consequently, when the container body 5 is covered with the lid 1, and the depressing member 3 in the higher position, the container body 5 will be sealed with the seal member 4. And, the lid 1 can be easily fitted in, and removed from the container body 5 when the depressing member 3 is in the lower position.

Figure 8:
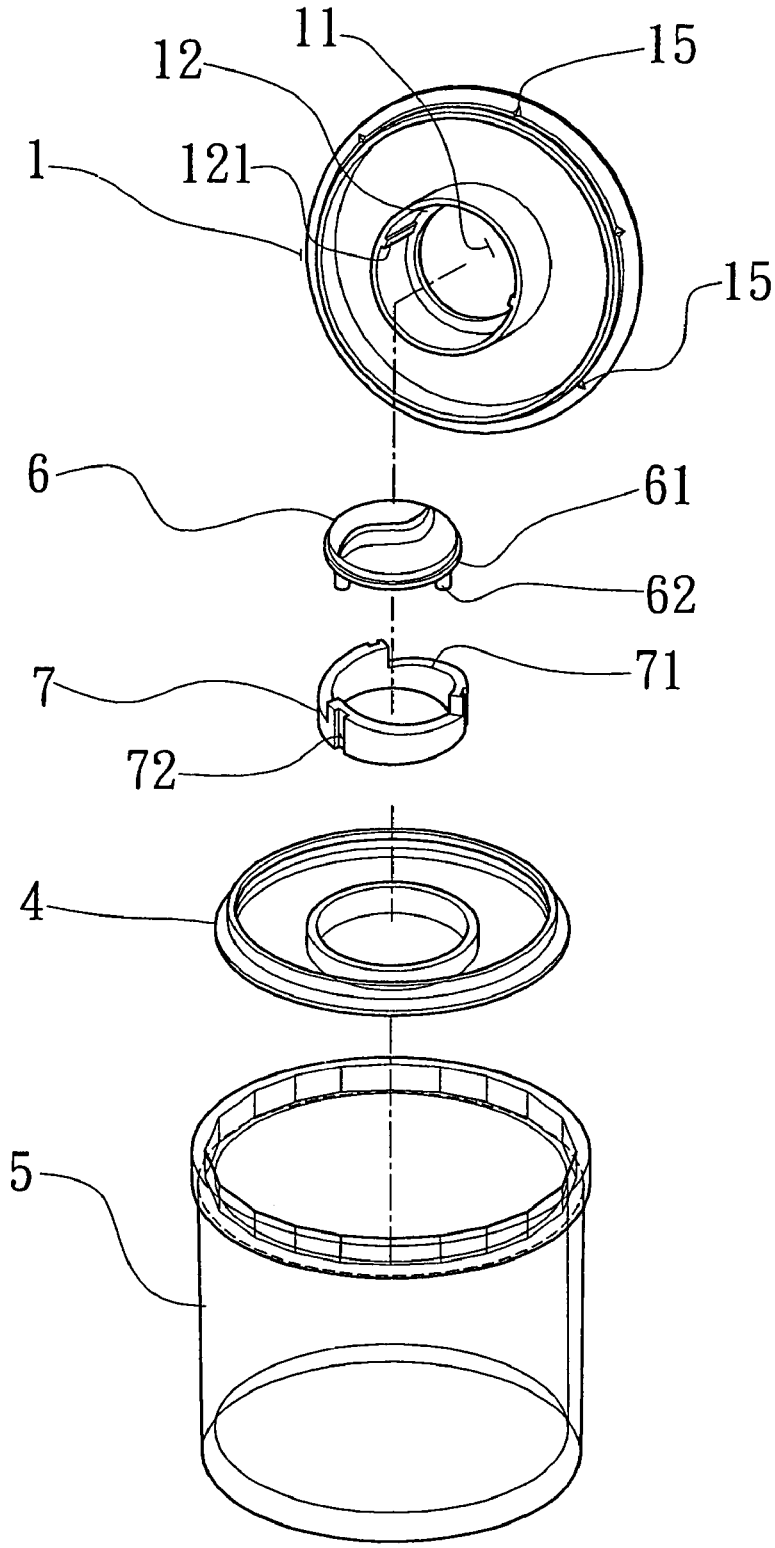
FIG. 8 is an exploded perspective view of the second embodiment of a seal container in the present invention.

Referring to FIG. 8, a second embodiment of a seal container is provided with a knob member 6, and a depressing member 7 instead of the knob member 2, and the depressing member 3; the knob member 6 has a rim 61, and several touching projections 62 spaced apart on an edge of a lower side. And, the depressing member 7 has several slopes 71 on an upper end, which contact respective ones of lower ends of the touching projections 62; the slopes 71 are formed such that lower ends thereof are adjacent to a higher end of a next slope 71. In addition, the depressing member 7 has several gaps 72 spaced apart on an outer annular side thereof, in which guide bumps 121 of lid 1 are respectively held. Thus, the second embodiment can be used in the same way as the first embodiment.

From the above description, it can be easily understood that the seal container of the present invention has advantages as followings:

1. Dust is less likely to accumulate in the holding room 12 of the lid 1 and between the knob member 2 and the lid 1 because the knob member 2 won't move up and down relative to the lid 1 when it is turned. Therefore, the knob member 2 and the depressing member 3 still can be smoothly moved even though the seal container has been used for a long time.
2. The present seal container is easer to manufacture and assemble than the second conventional one described in Background because of the structure, which is simpler, and in which the depressing member 3 will be up and down displaced relative to the lid 1 when the knob member 2 is turned at a fixed height.

What is claimed is:

1. A seal container, comprising a lid, the lid having a central hole, and an annular portion on a lower side thereof, which defines a holding room facing the central hole; the annular portion having a plurality of guide bumps spaced apart on an inner side thereof;

a knob member having a central raised portion, and a rim around the central raised portion; the knob member having a plurality of touching projections spaced apart on an edge of a lower side thereof; the knob member being passed through the central hole of the lid at the central raised portion with the central raised portion facing up and with the rim being confined in the holding room of the lid;

an annular depressing member, the depressing member having a plurality of upwards facing slopes of same shape formed thereon; the depressing member having a plurality of cavities spaced apart on an outer side thereof; the depressing member being held in the holding room of the lower side of the lid with the slopes thereof touching respective ones of lower ends of the touching projections of the knob member; the guide bumps of the lid being respectively held in the cavities of the depressing member such that the depressing member is prevented from turning relative to the lid, and such that the depressing member is allowed to move up and down relative to the lid;

a container body having an inner touching portion around an upper opening thereof; and a soft seal member for sealing the container body with; the soft seal member being fitted over the lower side of the lid, and connected with the lower side of the depressing member at a substantially middle portion thereof;

whereby the seal member will be depressed at the middle portion thereof by the depressing member, and reduced in circumference as soon as the knob member is turned to such a position that the touching projections thereof touch higher ends of the slopes of the depressing member; and whereby the seal member will stretch to a normal shape and closely touch the inner touching portion of the container body to seal the container body as soon as the knob member is turned to such a position that the touching projections thereof touch lower ends of the slopes of the depressing member.

2. The seal container as claimed in claim 1, wherein the lid is formed with a plurality of locating projections on an edge thereof, and the inner side of the container body is formed with a plurality of angle portions above the inner touching portion; thus, when the container body is covered with the lid, the locating projections will be held in the angle portions for preventing the lid from turning relative to the container body.

3. The seal container as claimed in claim 1, wherein there is a pair of locating bumps formed between every two adjacent ones of the guide bumps of the lid, which define a holding space in between while the knob member has an engaging projection formed on an edge of the rim; an elongated hole being formed near to the engaging projection on the rim of the knob member such that the engaging projection can be displaced when an external pushing force towards the elongated hole is exerted on the engaging projection; the engaging projection being going to pass into one of the holding spaces of the lid as soon as the depressing member is moved to the lower position, thus preventing the knob member from turning relative to the lid after the seal member has been moved to an unsealing position.

* * * * *